US005803447A

United States Patent [19]

Singer et al.

[11] Patent Number: 5,803,447

[45] Date of Patent: Sep. 8, 1998

[54] METHOD AND APPARATUS FOR FEEDING SHEETS

[75] Inventors: Karl Singer, Barrington Hills; Robert Allen Crimmins, Algonquin; Lawrence B. LeStarge, Elgin, all of Ill.

[73] Assignee: D&K Custom Machine Design, Inc., Elk Grove Village, Ill.

[21] Appl. No.: 718,923

[22] Filed: Sep. 25, 1996

[51] Int. Cl.[6] ..... B65H 5/08

[52] U.S. Cl. ..... 271/11; 271/107; 414/797

[58] Field of Search ..... 271/11, 90, 14, 271/103, 107, 30.1, 91; 414/797; 221/211

[56] References Cited

U.S. PATENT DOCUMENTS

| | | | |
|---|---|---|---|
| 2,341,521 | 2/1944 | Baker et al. | 271/103 |
| 2,815,948 | 12/1957 | Watter . | |
| 3,070,367 | 12/1962 | Schwebel . | |
| 3,411,640 | 11/1968 | Wallis . | |
| 3,724,687 | 4/1973 | Marschke et al. | 271/11 |
| 3,914,154 | 10/1975 | Pfeiffer . | |
| 3,921,971 | 11/1975 | Vollrath | 271/103 |
| 3,952,478 | 4/1976 | Richards et al. . | |
| 4,105,198 | 8/1978 | Stievenart et al. . | |
| 4,280,691 | 7/1981 | Blum . | |
| 4,394,011 | 7/1983 | Dalton . | |
| 4,470,589 | 9/1984 | Singer . | |
| 4,640,503 | 2/1987 | Naumann | 271/103 |
| 4,732,376 | 3/1988 | Umezawa . | |
| 5,076,565 | 12/1991 | Liepert . | |
| 5,102,113 | 4/1992 | Renner et al. . | |
| 5,137,267 | 8/1992 | Wirz et al. . | |
| 5,183,242 | 2/1993 | Crimmins et al. . | |
| 5,350,166 | 9/1994 | Shimizu et al. . | |
| 5,417,158 | 5/1995 | Parsio . | |
| 5,542,658 | 8/1996 | Witz et al. | 271/107 |

FOREIGN PATENT DOCUMENTS

| | | | |
|---|---|---|---|
| A-0253165 | 1/1988 | European Pat. Off. . | |
| 1131462 | 2/1957 | France | 414/797 |
| 2687652 | 8/1993 | France | 271/11 |
| 24 38 960 | 2/1976 | Germany . | |
| 3644201 A1 | 7/1988 | Germany . | |
| U 9001905 | 4/1990 | Germany . | |
| 4200393 | 7/1993 | Germany | 271/107 |
| 714699 | 9/1954 | United Kingdom | 271/91 |
| 2056414 | 3/1981 | United Kingdom | 271/91 |
| WO 93/04964 | 8/1992 | WIPO . | |

OTHER PUBLICATIONS

PCT International Search Report mailed Dec. 12, 1998.

Spare Parts—Feeder Brochure, MABEG Maschinenbau GmbH & Co. KG.

*Primary Examiner*—H. Grant Skaggs

*Attorney, Agent, or Firm*—Wallenstein & Wagner, Ltd.

[57] ABSTRACT

A feeder system is disclosed having suction members (30, 60) attached to a cage assembly (101) containing sprockets (102,103) and a belt. These suction members (30,60) act simultaneously, but out of phase with one another, picking up, moving and releasing the sheets (TS).

27 Claims, 7 Drawing Sheets

METHOD AND APPARATUS FOR FEEDING SHEETS

TECHNICAL FIELD

The present invention relates generally to laminating machines and, more particularly, to a novel sheet feeding assembly and method that are fast, efficient, easy to set up and involve a minimum number of components.

BACKGROUND PRIOR ART

Today, there are numerous uses and applications of laminated products. Such products typically include a sheet of paper disposed between two sheets of film. Examples of such products include menus, book covers, presentation folders, boxes, video cassette cases, record and CD jackets and displays for stores. Prior to lamination, the sheets to be laminated are often precut and stacked. Once stacked, the sheets are individually fed by a sheet feeder to a lamination unit. This process involves two important aspects. The first is the actual feeding mechanism which lifts and physically moves the individual sheets to the laminator. This aspect of the system is required to work at high speeds with both great accuracy and consistency. The second aspect is the registration and indexing system. Prior to entering the laminating portion of the machine, it is important to ensure the sheets are properly aligned to the laminator. Improper alignment results in damage and/or inconsistencies in the final product, not to mention down-time to realign or repair the system. In an effort to continuously improve upon the laminating process and machines available in the marketplace, the following advancements and improvements were developed to the apparatus and method of initially feeding the individual sheets to the registration and indexing portion of the laminating machine.

SUMMARY OF THE INVENTION

According to a first aspect of the present invention, a sheet feeding apparatus and method are disclosed that include a vertically moveable platform that supports a stack of sheets with an exposed top sheet. A pair of first suction members having first vacuum means for holding the top sheet are movable along a generally horizontal path between a first (pick-up) position and a second (drop-off) position. This movement between the first and second positions is performed while this first suction members are holding the top sheet. The return movement between the second and first positions is performed while the first suction members are without a sheet. Each suction member has a sucker cup attached via a hollow rod to a pneumatic or hydraulic cylinder. As a result, when the vacuum is ON, each first suction member will drive along a generally vertical path between a pick-up (UP) position and a pick-up (DOWN) position without holding a sheet and between this DOWN position and an INTERMEDIATE position (above the DOWN position and below the UP position) while holding the top sheet. A first cage assembly is further provided for each first suction member for supporting and moving the first suction member between the pick-up position and the drop-off position. Switch means turn the first vacuum means ON and OFF permitting the first suction members to be driven to the top sheet and to hold the top sheet.

Similarly, a pair of second suction members having second vacuum means for holding the top sheet are movable along a similar parallel generally horizontal path between a pick-up position and a drop-off position. This movement between the pick-up and drop-off positions is performed while these second suction members are holding another top sheet. The return movement between the drop-off and pick-up positions is performed while the second suction members are without a sheet. As with the first suction members, these second suction members each have a sucker cup attached via a hollow rod to a pneumatic cylinder. As a result, when the vacuum is ON, the second suction members will drive along a generally vertical path between an UP position and a DOWN position without holding a sheet and between the DOWN position and an INTERMEDIATE position while holding the top sheet. Additionally, cage assemblies are further provided for supporting and moving each of the second suction members between the pick-up and drop-off positions. Switch means turn this second vacuum means ON and OFF permitting the second suction members to be driven to the top sheet and to hold the top sheet.

The above movements and activities are synchronized such that while the first pair of suction members are moving from the first (pick-up) position to the second (drop-off) position with a top sheet, the second pair of suction members are moving from the second position to the first position without a sheet. And, while the first suction members are moving from the second position to the first position without a sheet, the second suction members are moving from the first position to the second position with a top sheet.

According to another aspect of the present invention, the cage assemblies are constructed with two sprockets therein, each sprocket being proximate each end thereof. A belt is entrained around the sprockets and the suction members are attached to this belt. In particular, each first suction member is connected to the upper part of the belt in one cage assembly and each second suction member is connected to the lower part of the belt in the other cage assembly. Thus, a single reciprocating motor or cam/linkage combination rotates a central drive shaft connected to one sprocket of each cage assembly. Consequently, when the motor rotates the drive shaft in a first direction, the first suction members travel from the first pick-up position to the second drop-off position and the second suction members simultaneously travel from the second drop-off position to the first pick-up position. And, when the drive shaft is rotating in the second direction, the first suction members travel from the second position to the first position and the second suction members simultaneously travel from the first position to the second position.

The central drive shaft is splined for cooperating with each of the sprockets it is in communication with. Moreover, the cage assemblies each support a slide rail disposed below and between the sprockets. This slide rail has a track disposed therein. A glide frame attached to the suction members includes a glide element that is contoured to cooperate with the track in the slide rail. A bracket connects the suction member to the entrained belt.

The cages are supported on a transverse support rod permitting movement of the cages relative to the support rod. Each cage can be selectively locked into a position on the support rod to selectively control the transverse distance between each cage.

Other advantages and aspects of the present invention will become apparent upon reading the following description of the drawings and the detailed description of the invention.

BRIEF DESCRIPTION OF DRAWINGS

To understand the present invention, it will now be described by way of example, with reference to the accompanying drawings in which.

DETAILED DESCRIPTION

Figure 1:
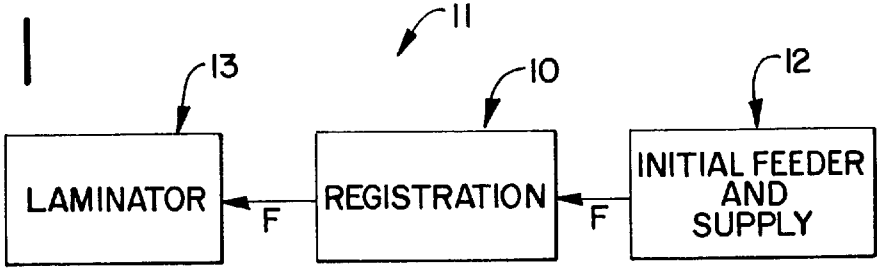
FIG. 1 is a block diagram of the overall system.

While this invention is susceptible of embodiment in many different forms, there is shown in the drawings and will herein be described in detail a preferred embodiment of the invention with the understanding that the present disclosure is to be considered as an exemplification of the principles of the invention and is not intended to limit the broad aspect of the invention to embodiment illustrated.

The initial feeder system or initial feeder assembly is the part of the laminating machinery disposed between the feeder box and the nip rollers. At the input side of a laminating machine there is either a plurality of sheets stacked or a supply roller of a continuous sheet. The sheet(s) of material(s) are laminated by the laminating machine on either one side or both sides by a plastic film. Details of commercially successful laminating machines can be found in U.S. Pat. Nos. 4,329,896; 4,470,589; 4,517,042; 4,743,334; 5,019,203; 5,071,504; 5,079,981 and 5,139,600 manufactured and owned by Assignee of the present invention, D&K Custom Machine Design, Inc. (Elk Grove Village, Ill.), incorporated herein by reference.

Individual sheets are typically fed into the feeder assembly by a sheet feeder, such as the ones described in U.S. Pat. Nos. 4,470,589 and 5,183,242, both also manufactured and owned by the Assignee of the present invention, D&K Custom Machine Design, Inc., and incorporated herein by reference.

From the initial feeder, the sheets are pulled into the laminator. Or, they enter a registration and alignment system. Such a registration system is shown in U.S. Ser. No. 08/719,730, filed the same day as this application, Sep. 25, 1996, and titled METHOD AND APPARATUS FOR REGISTERING SHEETS (Our File No. 251 P 072), also manufactured and owned by the Assignee of the present invention, D&K Custom Machine Design, Inc., and incorporated herein by reference.

Figure 2:
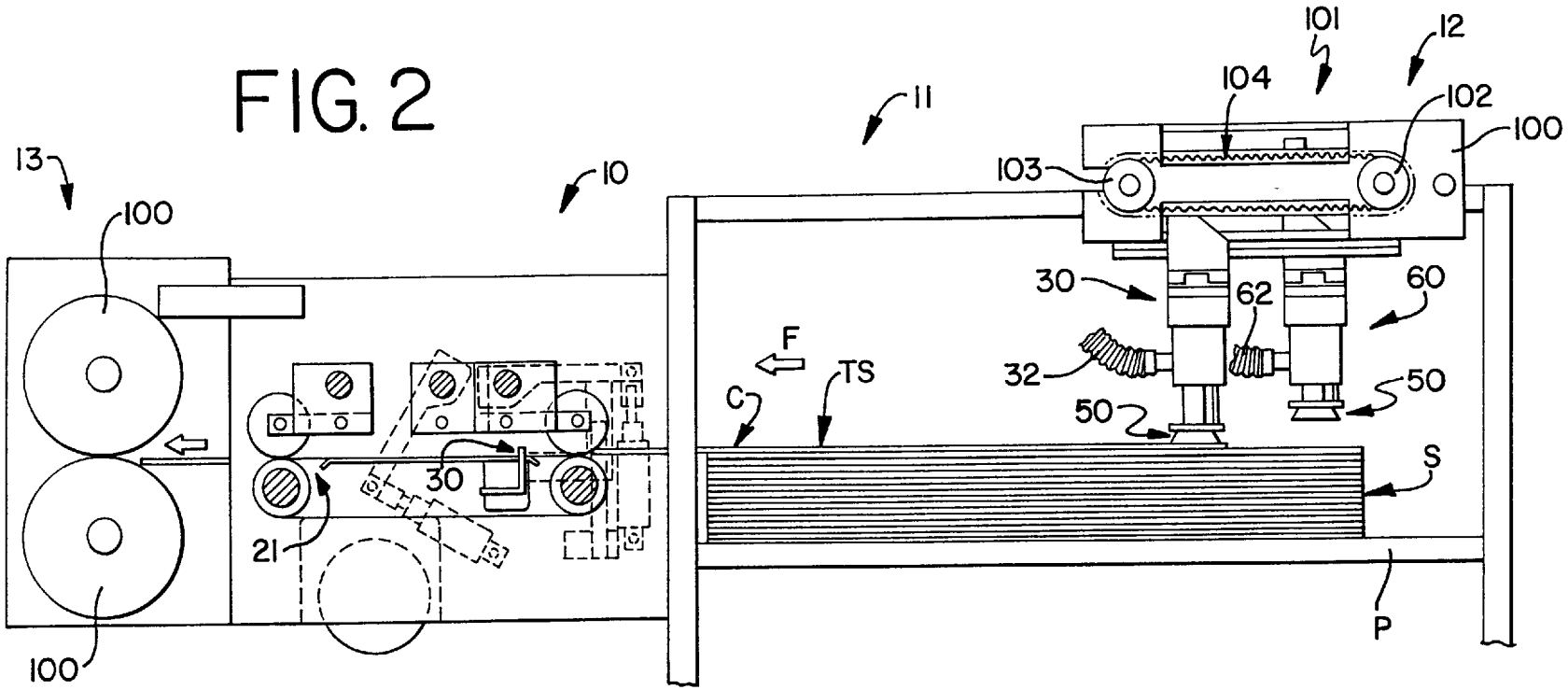
FIG. 2 is a side elevation view of the initial feeder section and the registration section of the present invention.
Figure 3:
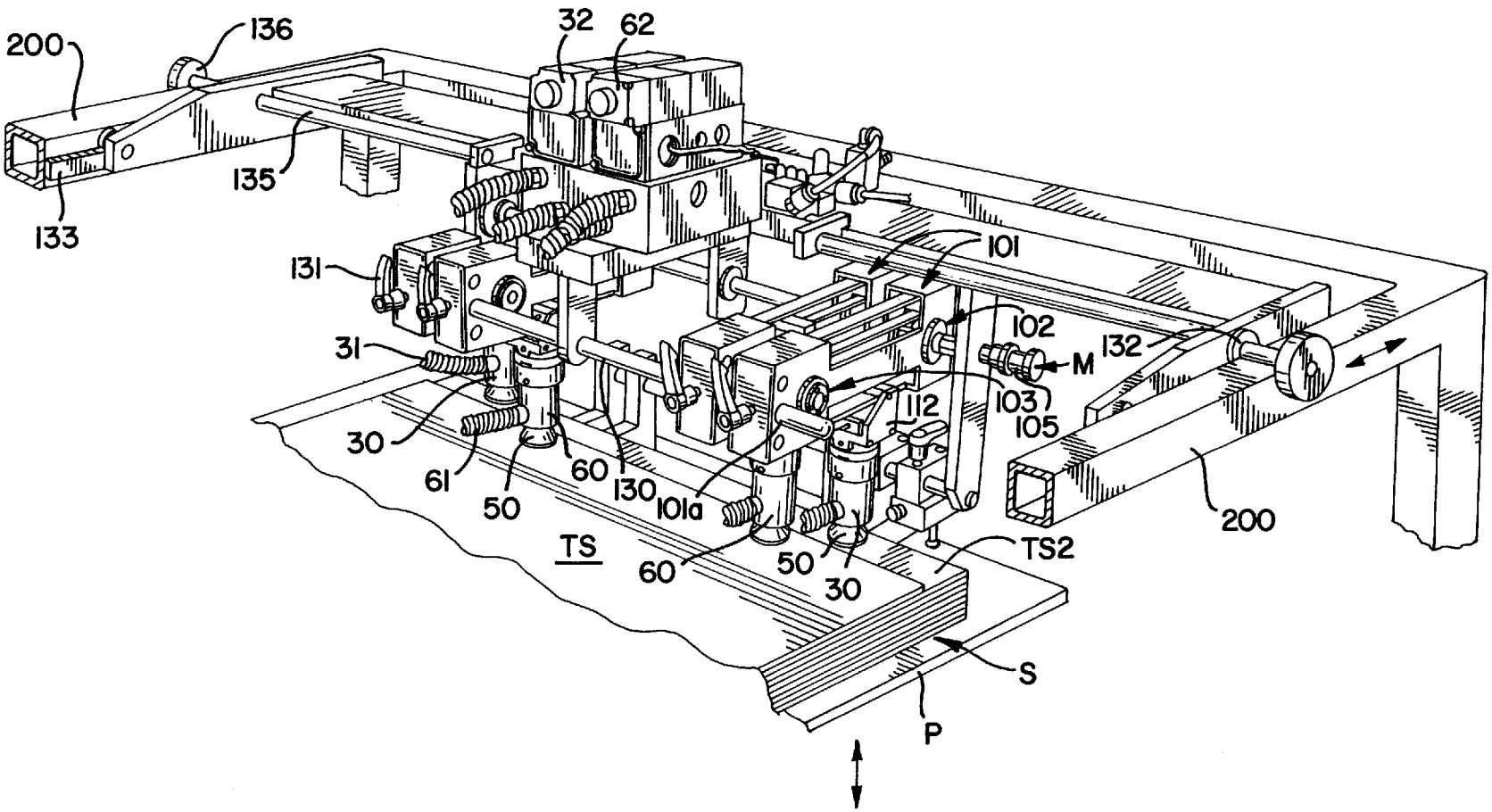
FIG. 3 is a top perspective view of the initial sheet feeding apparatus of the present invention.

As shown generally in FIG. 1 and in more detail in FIGS. 2 and 3, the feeding apparatus 12 is the part of the laminating machinery 11 disposed between the supply of sheets (S) and the nip rollers 100 (or, if present, the registration system 10) for the laminator 13. At the input side of a laminating machine there is either a plurality of sheets (S) stacked or a supply roller of a continuous sheet. In the embodiment shown, a platform (P) is provided for supporting a stack of sheets (S). This platform (P) is raised by conventional means as the sheets are removed therefrom. As a result, each exposed top sheet (TS) is generally at the same level.

Figure 4:
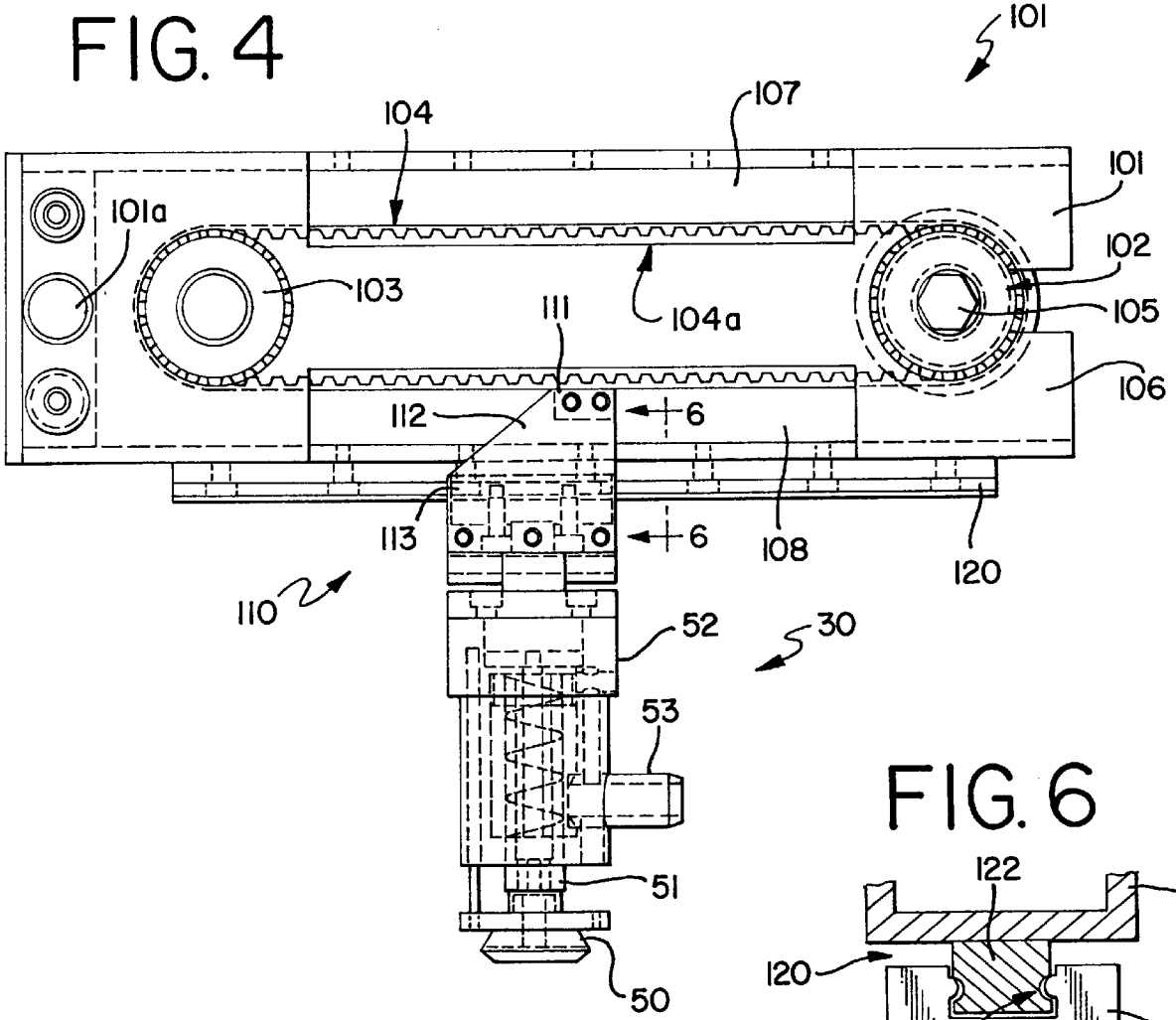
FIG. 4 is a detail side elevation view of the first suction member and cage assembly.
Figure 6:
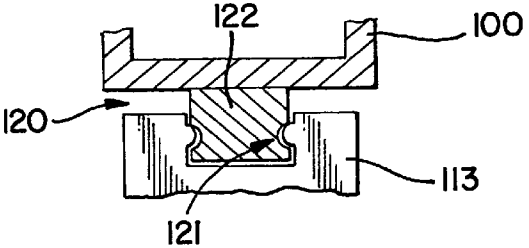
FIG. 6 is a sectional view along line 6—6 in FIG. 4.
Figure 11:
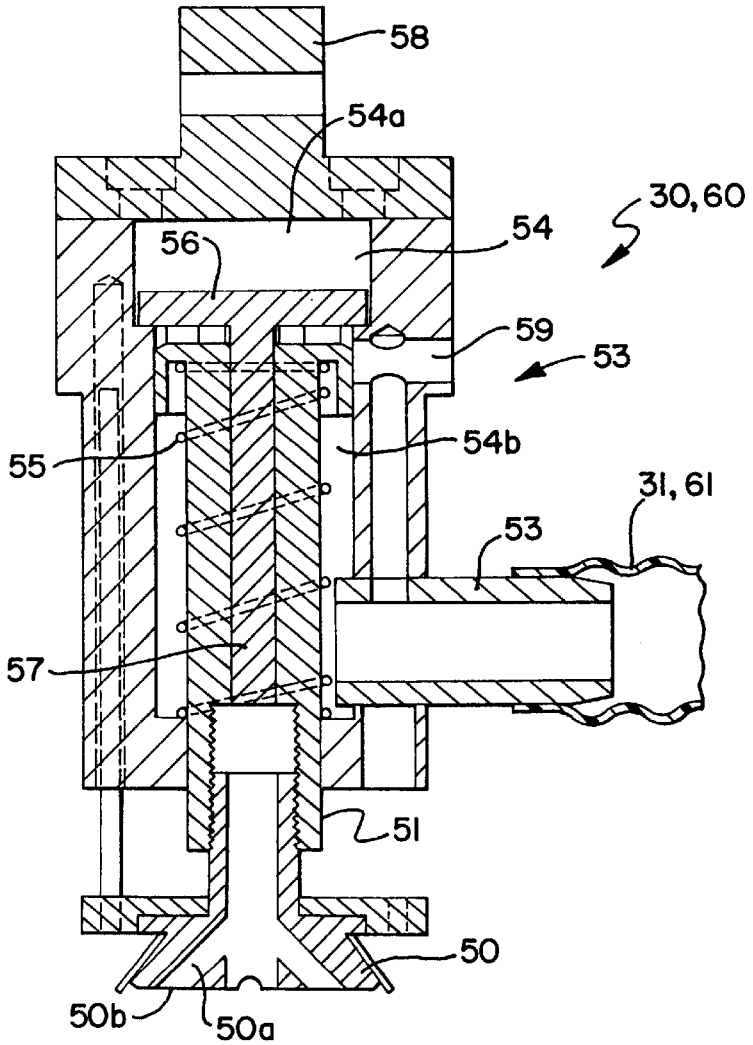
FIG. 11 is a sectional view of the suction members.

There are two horizontally parallel first suction members 30 and two horizontally parallel second suction members 60. The two first suction members 30 work and act simultaneously and the two second suction members 60 work and act simultaneously. Each suction member is connected to a vacuum line 31,61 and vacuum 32,62 for introducing a vacuum to the suction member and for causing the suction member to act in a certain prescribed manner. Specifically, as shown in FIGS. 11 and 4, the suction members 30,60 are generally alike, except possibly the position of the vacuum ports 35,65 thereon. One port may be right-handed, while the other port may be left-handed. Each suction member 30,60 moves vertically between three positions, that being an "UP" position, a "DOWN" position and an "INTERMEDIATE" position. (See FIG. 12). Moreover, each suction member is connected to moving means 101 for moving the suction member horizontally between a first "pick-up" position and a second "drop-off" position.

Turning to the mechanics of the suction members, each suction member 30,60 has a sucker cup 50 secured to the distal end of a movable rod 51 of a hydraulic or pneumatic cylinder 52. This extendable/retractable hollow rod 51 connects the sucker cup 50 to the pneumatic cylinder or chamber 52. This chamber 52 has a port 53 therein connected to a vacuum line 31,61. The hollow rod 51 is oriented so as to move in a generally vertical direction between the UP position and the DOWN position. The UP position is when the sucker cup 50 is closest to the pneumatic cylinder 52 and the DOWN position is when the rod 51 is fully extended and the sucker cup is at its farthest point from the pneumatic cylinder 52.

In addition to the hollow rod and sucker cup, the cylinder 52 includes an internal chamber 54 (both an upper chamber 54*a* and a lower chamber 54*b*) in communication with the vacuum port 53 (to the lower chamber). There is further a biasing spring 55, an internal cap 56 with an extending pin 57, an external cap 58, and a bypass port 59 between the lower chamber 54*b* and the port 53. As shown, the sucker cups 50 have internal veins 50*a* and openings 50*b* and are in direct communication with the vacuum lines 31,61.

Acceptable suction members can be obtained from MABEG Machinenbau GmbH & Co. KG, Main, Germany, Order Nos. 3 (Forwarder Sucker, Left Compliment), 4 (2-Step Sucker Housing), and 14 (Forwarder Sucker, Right Compliment).

When the vacuum is OFF, the sucker cup is in the retracted, UP position. Once the vacuum is turned ON, the sucker cup immediately extends to the DOWN position. If the sucker cup contacts an external object and holds that item, resulting in the blocking of the openings therein, the sucker cup retracts to an INTERMEDIATE position. Accordingly, the following pattern is followed:

| Vacuum Source | With/Without Item | Sucker Cup Position |
|---|---|---|
| OFF | Without an Item | UP Position |
| ON | Without an Item | DOWN Position |
| ON | With an Item | INTERMEDIATE Position |

Each of the suction members 30,60 cooperates with a cage assembly 101. The cage assemblies 101 are alike except for the points of connection with the suction members. In particular, the cage 101 supports two sprockets 102,103 therein, one adjacent each end thereof. A belt 104 is entrained around the two sprockets 102,103 and each suction member 30,60 is attached to the belt. One sprocket (the first sprocket) 102 is driven via a drive shaft 105 by an external reciprocating motor (M) (or other combination cam/linkage equivalent) and the other sprocket (the second sprocket) 103 is driven by the motor driven sprocket 102 and the entrained belt 104. In the preferred embodiment the belt is serrated 104*a* for precision movement and no slip, and the drive shaft 105 is splined (shown as a hexagon) for cooperating with the sprocket 102. The cage supports the sprockets by bearings 106. Each cage has parallel upper slots 107 and parallel lower slots 108 disposed between the sprockets 102,103.

Figure 5:
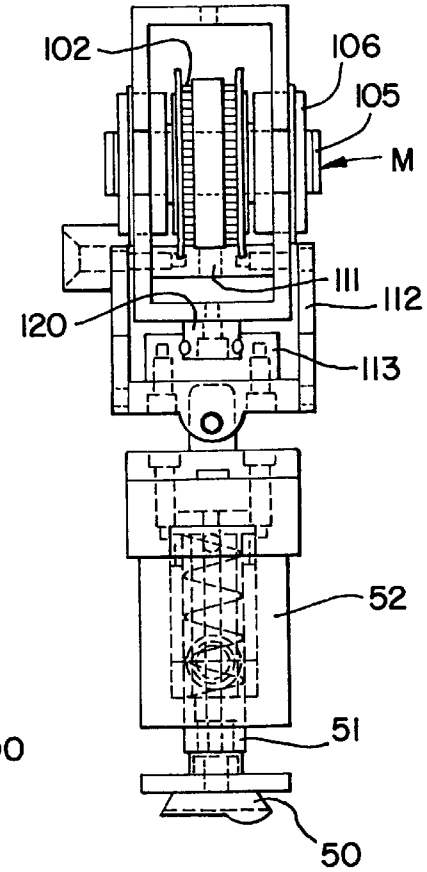
FIG. 5 is an end elevation of the first suction member and cage assembly of FIG. 4.
Figure 8:
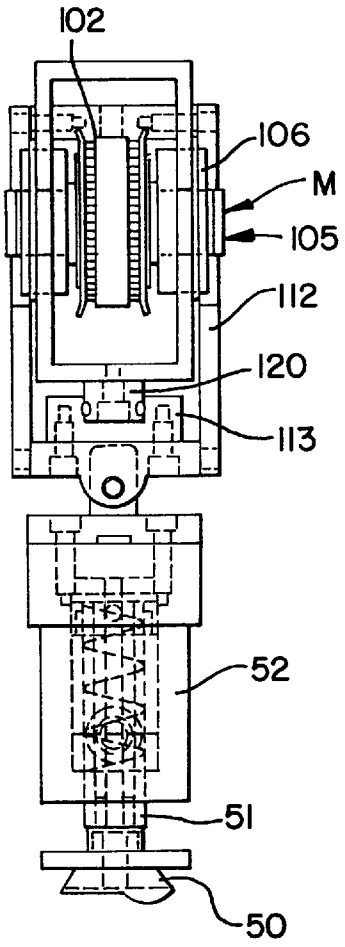
FIG. 8 is an end elevation of the second suction member and cage assembly of FIG. 7.
Figure 7:
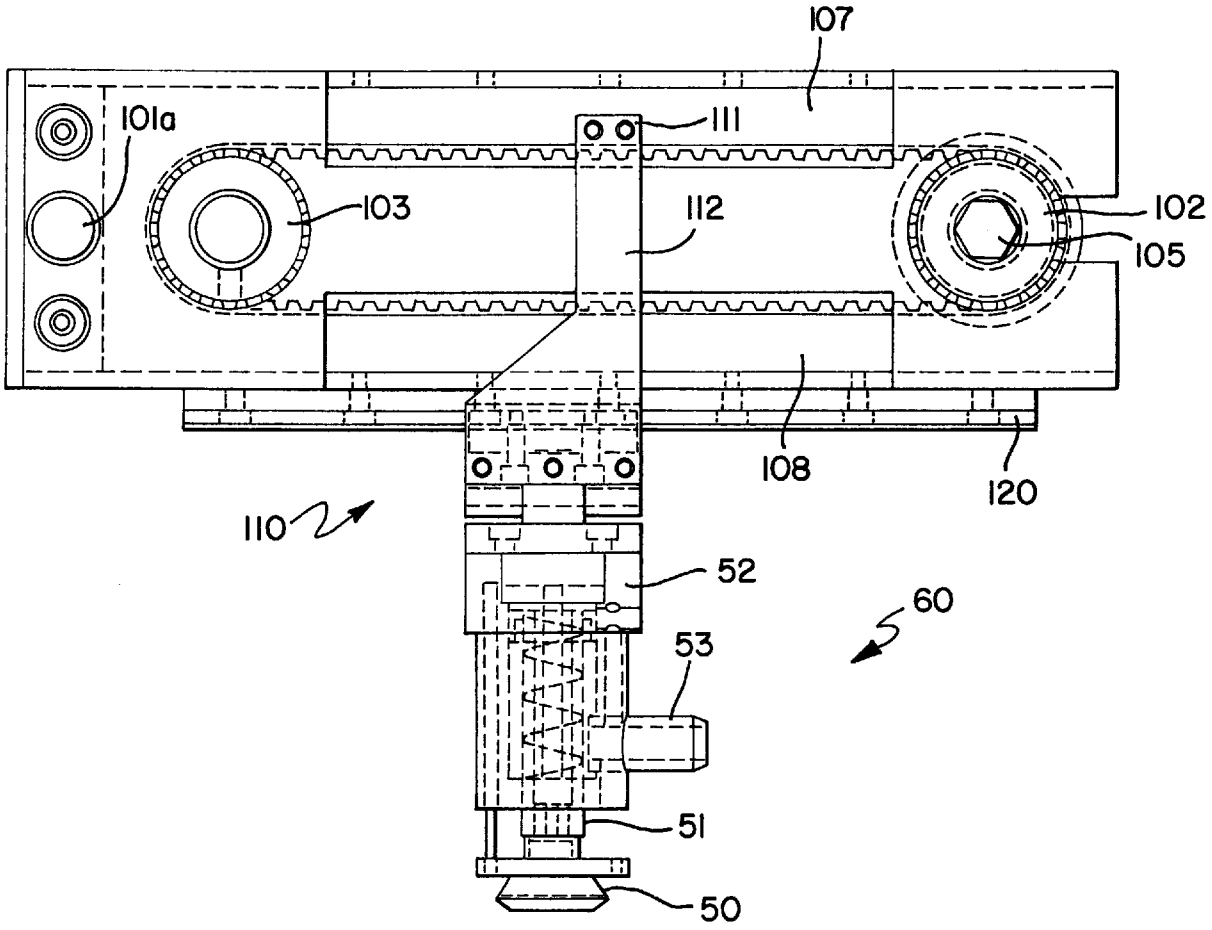
FIG. 7 is a detail side elevation view of the second suction member and cage assembly.
Figure 9:
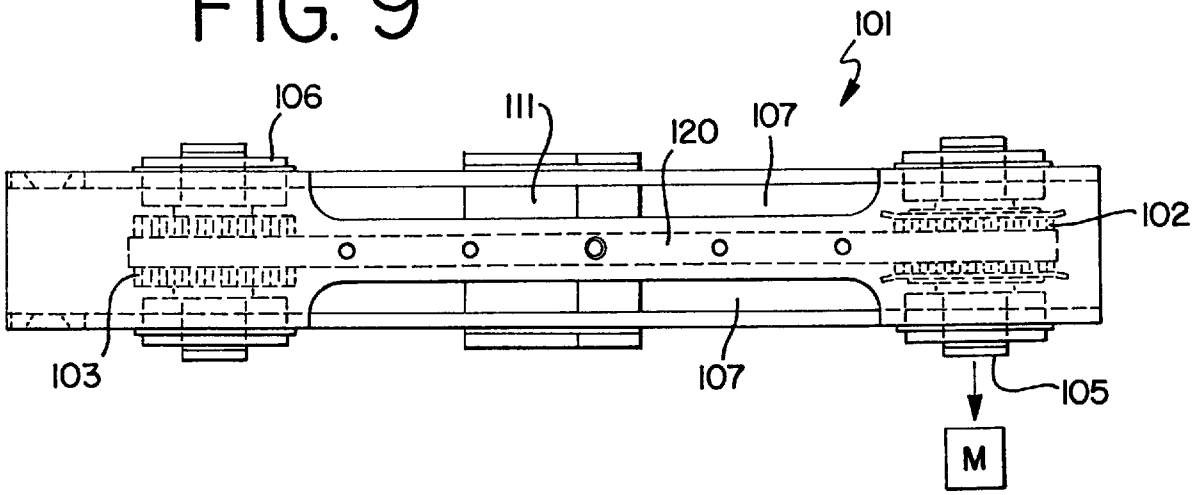
FIG. 9 is a top plan view of a cage assembly.
Figure 10:
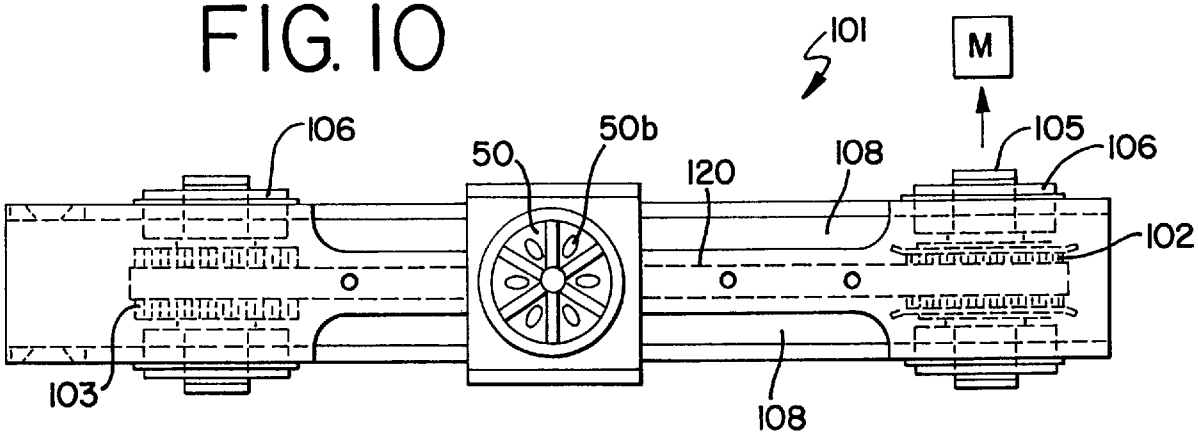
FIG. 10 is a bottom plan view of a cage assembly.

One set of suction members are connected to the upper portion of the belt (FIGS. 7 and 8) and the other set of suction members are connected to the lower section of the belt (FIGS. 4 and 5). Thus, as demonstrated in FIG. 13, when the motor rotates the drive shaft in one direction, the set of suction members connected to the upper belt portion moves from a first home position horizontally to a second home position while the other set of suction members connected to the lower belt portion moves from a second home position horizontally to a first home position. In the embodiment shown, when the motor rotates the drive shaft in a clockwise direction, the second set of suction members 60 connected to the upper belt portion 104 moves from a pick-up position horizontally to a drop-off position while the first set of suction members 30 connected to the lower belt portion 104 moves from a drop-off position to a pick-up position. Similarly, when the motor rotates the drive shaft in a counterclockwise direction, the second set of suction members moves from a drop-off position to a pick-up position while the first set of suction members moves from a pick-up position to a drop-off position.

The suction member 30,60 is attached to the belt 104 by glide frame 110 which includes a top piece 111 having conventional fasteners (rivets, nuts/bolts, etc.) passing therethrough connecting it to the belt 104 (smooth side as opposed to serrated side). The top piece 111 is connected by two parallel brackets 112 that depend therefrom. These opposed brackets 112 further support the suction member 30,60 and are connected to a glide element 113.

A guide 120 is connected (via conventional fasteners) to the bottom of the cage 101 between the two sprockets 102,103 and below the parallel lower slots 107,108. This guide is a slide rail 122 with a track 121 disposed therein.

The glide element 113 is contoured to cooperate to mate (it has inwardly projecting protuberances) with the guide 120, that being the slide rail 122 and the track 121, permitting precision movement of the suction members 30,60 between the pick-up and drop-off positions.

Each cage 101 has an aperture therein 101*a* and is supported on a transverse support rod 130 (FIG. 3). A set screw 131 passing through the cage 101 and contacting the support rod 130 permits one to selectively move and secure the cage in one of numerous transverse positions. In short, each cage is moveable relative to the support rod and can be selectively locked into a position on the support rod to selectively control the transverse distance between each cage assembly and to accommodate sheets of different widths.

In addition, the entire assembly (cage assemblies, vacuum machines, suction members and rod) are supported on a longitudinal positioning shaft 135. This shaft 135 is attached to a gripping wheel 135 and parallel gear 132.

This gear cooperates with a serrated track 133 on the machines' frame 200. Accordingly, by rotating the wheel 136, the gear 132 will move relative to the track 133 and frame 200 to accommodate sheets of different lengths.

Conventional switches and control means and techniques control the ON/OFF of the vacuums and the ON/OFF and reciprocating movement of the drive shaft connected to the motor.

As a result of the above construction, each suction member goes through the following sequence:

1) The suction or gripper member (30 or 60) is positioned at the pick-up position (a point adjacent to the first sprocket 102) with the vacuum (32 or 62) OFF and the sucker cup (50) in the UP position (FIG. 12, Position A);
2) The vacuum (32 or 62) is turned ON, and the sucker cup (50) is extended vertically towards the sheet (TS) to be picked up and the DOWN position (FIG. 12, Position C);
3) With the vacuum (32 or 62) ON, the sucker cup (50) contacts the sheet (TS) to be picked up (DOWN position (FIG. 12, Position C));
4) With the vacuum (32 or 62) ON, the sucker cup (50) picks up the sheet (TS) and immediately moves to the INTERMEDIATE position (FIG. 12, Position B);
5) The suction member (30 or 60) is moved via the cage assembly 101 with the vacuum (32 or 62) ON and the sucker cup (50) in the INTERMEDIATE position (FIG. 12, Position B) and holding the sheet to the drop-off position (a point adjacent to the second sprocket 103);
6) The suction member (30 or 60) reaches the drop-off position (a point adjacent to the second sprocket 103) with the vacuum (32 or 62) ON and the sucker cup (50) in the INTERMEDIATE position (FIG. 12, Position B) and holding the sheet (TS);
7) The vacuum (32 or 62) is turned OFF, the sheet (TS) is released from the sucker cup (50) and the sucker cup (50) moves to the UP position (FIG. 12, Position A);
8) The suction member (30 or 60) is moved with the vacuum (32 or 62) OFF and the sucker cup (50) in the UP position (FIG. 12, Position A) and without a sheet to the pick-up position (a point adjacent to the first sprocket 102).

The switches and controls are coordinated to perform the sequences above following this cycle:

1) while the first gripper member (30) is moving from the first position (a point adjacent to the first sprocket 102) to the second position (a point adjacent to the second sprocket 103) with a top sheet (TS), the second gripper member (60) is moving from the second position (a point adjacent to the second sprocket 103) to the first position (a point adjacent to the first sprocket 102) without a sheet;
2) while the first gripper member (30) is moving from the second position (a point adjacent to the second sprocket 103) to the first position (a point adjacent to the first sprocket 102) without a sheet, the second gripper member (60) is moving from the first position (a point adjacent to the first sprocket 102) to the second position (a point adjacent to the second sprocket 103) with a top sheet (TS).

Figure 12:
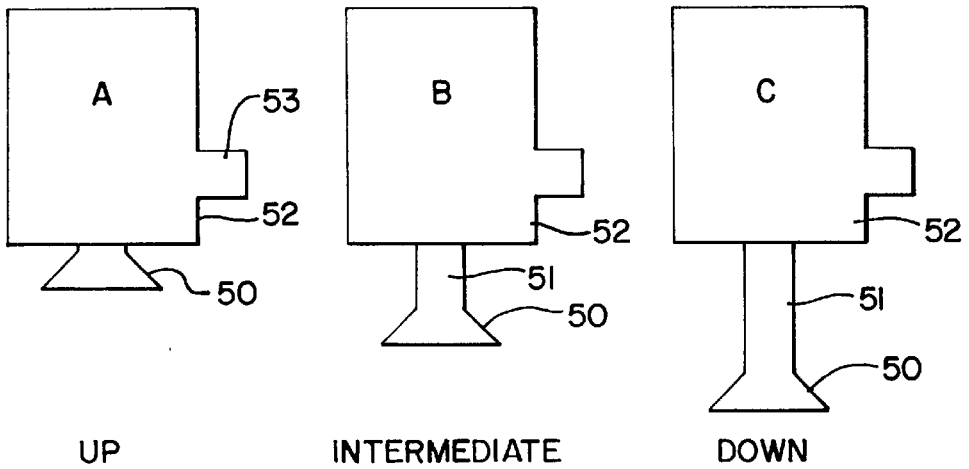
FIG. 12 is a schematic diagram of the suction members.

In addition, the following tasks are performed simultaneously:

1) turning the first vacuum means (32) ON to drive the first gripper member (30) vertically downwardly (FIG. 12, from Position A to Position C) to pick up the top sheet (TS) and vertically upwardly with the top sheet (FIG. 12, from Position C to Position B); and, 2) turning the second vacuum means (62) OFF to release the top sheet (TS) from the second gripper member (60), resulting in the second gripper member moving vertically upward (FIG. 12, from Position B to Position A).

With the above arrangement, the motor reciprocates turning the drive shaft 105 one direction and then another direction. As the first gripper member 30 travels one direction, the second gripper member 60 travels the other direction. This cycle is repeatable so long as sheets need to be fed to the machinery. Because the gripper members 30,60 travel in the UP position without a sheet and in the INTERMEDIATE position with a sheet, the members do not interfere with one another as they pass one another. The suction member in the UP position passes above and by the suction member in the INTERMEDIATE position with a sheet.

Figure 13:
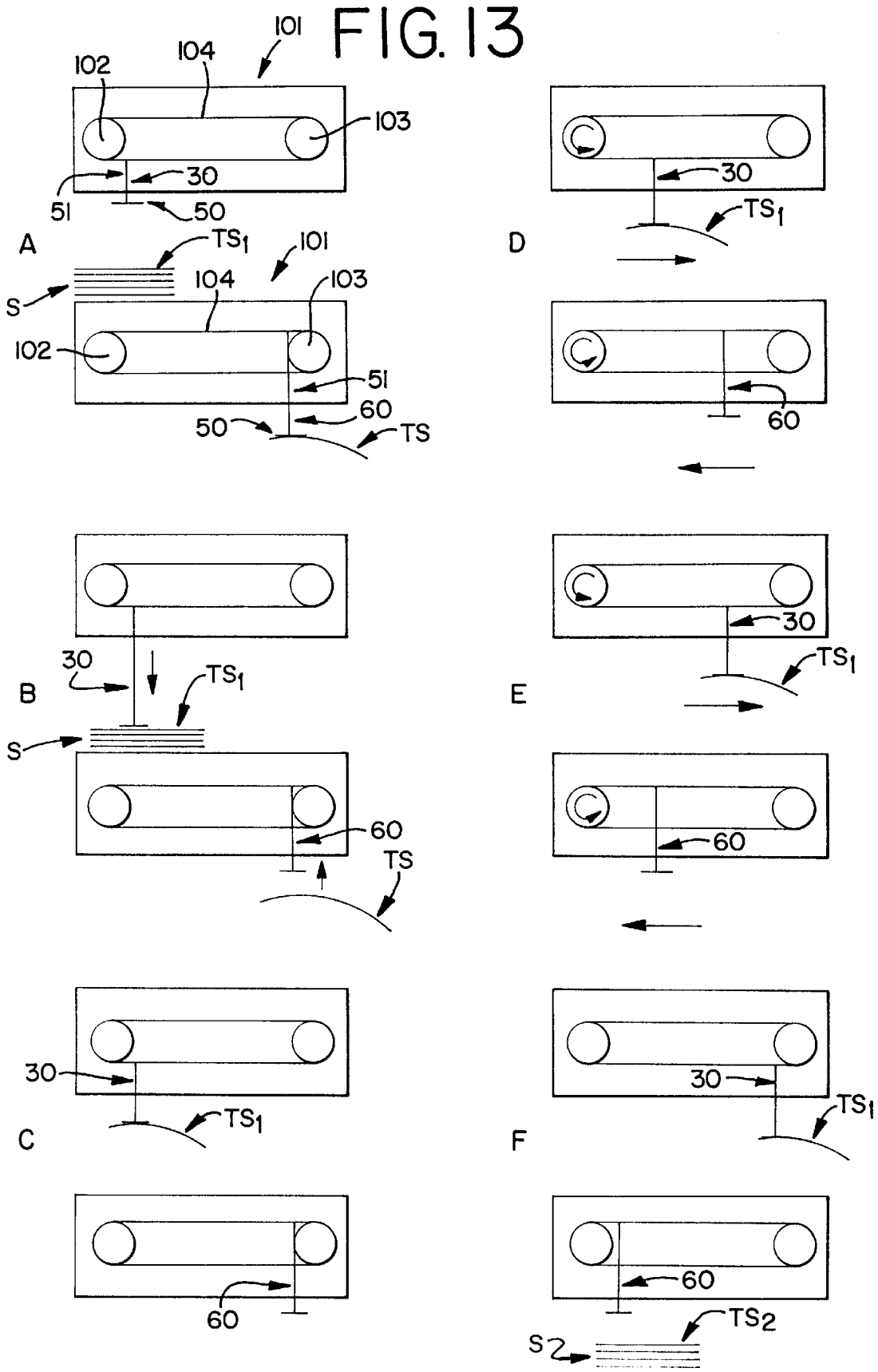
FIG. 13 is a schematic diagram of the motion and actions of the cage assemblies and suction members.

FIG. 13 shows one-half of the above sequence and cycle. Specifically, FIG. 13 shows the portion of the sequence wherein the first suction member 30 picks up the top sheet (TS1) at the pick-up location and takes the sheet to the drop-off location while the second suction member 60 moves without a sheet from the drop-off location to the pick-up location. This cycle A—F continues with the modification that the first suction member 30 moves in the manner that the second suction member 60 moved in the A—F cycle and the second suction member 60 moves in the manner that the first suction member 30 moved in the A—F cycle.

Finally, while not shown, a clip (C) is often placed adjacent an edge of the sheets (S) on the platform (P) ensuring they will not move during the initial feeding process. This clip, placed adjacent the leading edge (LE) and contacting the top sheet (TS), prevents the sheets from being lifted and moved directly downstream. Accordingly, when the suction member drives down vertically and picks up the sheet (TS1), it will, instead of moving directly downstream horizontally, move horizontally upstream. The distance travelled upstream is enough to permit the sheet to clear the clip (C). Once the clip is cleared, the suction member will move horizontally downstream, as discussed above. This upstream movement is also controlled by the reciprocating motor and the belt. The other opposed suction member will, of course, move the small distance downstream beyond the drop-off location before progressing upstream to the pick-up position. As a result, the suction member will in practice: 1) pick-up the sheet at the pick-up location; 2) draw upstream to clear the clip; 3) move downstream to the drop-off location; 4) move downstream a small amount beyond the drop-off location (while the other suction member is drawing upstream to clear the clip); and 5) move back upstream to the pick-up location.

While the specific embodiments have been illustrated and described, numerous modifications are possible without significantly departing from the spirit of the invention and the scope of protection is only limited by the scope of the accompanying Claims.

We claim:

1. A sheet feeding apparatus comprising:

A) a platform for supporting a stack of sheets with an exposed top sheet;

B) a suction member having vacuum means for holding the top sheet and being movable along a generally horizontal path between a first horizontal position and a position downstream from the first horizontal position while holding the top sheet and between a position downstream from the first horizontal position and the first horizontal position without holding a sheet;

C) means for driving the suction member along a generally vertical path between a first vertical position and a position above the first vertical position while holding a sheet and between a position above the first vertical position and the first vertical position without holding the top sheet;

D) switch means for turning the vacuum means ON and OFF, the suction member being driven or holding the top sheet when the vacuum means is ON; and, E) guide means for supporting and moving the suction member between the first horizontal position and a position downstream from the first horizontal position, the guide means including a cage assembly hiving two sprockets therein with one sprocket proximate each end thereof and a belt entrained around the sprockets and a guide disposed between the sprockets, the suction member being attached to the belt and having a glide frame cooperating with the guide and supporting the suction member.

2. The feeder apparatus of claim 1 wherein the suction member is a sucker cup secured by a rod to a pneumatic or hydraulic cylinder connected to a vacuum line, the rod and sucker cup moveable in a generally vertical direction between the first vertical position and a position above the first vertical position.

3. The feeder apparatus of claim 1 wherein one sprocket in the cage assembly is driven by a reciprocating motor and the other sprocket is driven by the entrained belt, the motor rotating a central drive shaft in a first direction and a second direction such that when the drive shaft is rotating in the first direction the suction member travels from the first horizontal position to a downstream horizontal position and when the drive shaft is rotating in the second direction the suction member travels from a downstream horizontal position to the first horizontal position.

4. The feeder apparatus of claim 3 wherein the central drive shaft is splined for cooperating with the one sprocket and the guide is a slide rail having a track disposed therein and the glide frame includes a glide element cooperating with the track in the slide rail and having a bracket connected to the entrained belt at one end thereof and the suction member at the other end thereof.

5. The feeder apparatus of claim 4 wherein there are at least two suction members and one cage assembly for each suction member.

6. The feeder apparatus of claim 5 Wherein each cage assembly is supported on a transverse support rod and adapted to be moveable relative to the support rod and selectively locked into a position on the support rod to selectively control the transverse distance between each cage assembly.

7. The feeder apparatus of claim 1 further including:

F) a second suction member having second vacuum means for holding the top sheet and being movable along a generally horizontal path between a first horizontal position and a position downstream from the first horizontal position while holding the top sheet and between a position downstream from the first horizontal position and the first horizontal position without Molding a sheet;

G) means for driving the second suction member along a generally vertical path between a first vertical position and a position above the first vertical position while holding a sheet and between a position above the first vertical position and the first vertical position without holding the top sheet;

H) second switch mean for turning the vacuum means ON and OFF, the second suction member being driven or holding the top sheet when the vacuum means is ON; and, I) second guide means for supporting and moving the suction member between the first horizontal position and a position downstream from the first horizontal position.

8. The feeder apparatus of claim 7 wherein the suction members are each a sucker cup secured by a rod to a pneumatic or hydraulic cylinder connected to a vacuum line, the rod and sucker cup moveable in a generally vertical direction between the first vertical position and a position above the first vertical position.

9. The feeder apparatus of claim 8 wherein each guide means includes a cage assembly having two sprockets therein with one sprocket proximate each end thereof and a belt entrained around the sprockets and a guide disposed between the sprockets, the suction member being attached to the belt and having a glide frame cooperating with the guide and supporting the suction member.

10. The feeder apparatus of claim 9 wherein one sprocket in each cage assembly is driven by a reciprocating motor and the other sprocket is driven by the entrained belt, the motor rotating a central drive shaft in a first direction and a second direction such that when the drive shaft is rotating in the first direction the first suction member travels from the first horizontal position to a position downstream from the first horizontal position while the second suction member travels from a position downstream from the first horizontal position to the first horizontal position and when the drive shaft is rotating in the second direction the second suction member travels from the first horizontal position to a position downstream from the first horizontal position while the first suction member travels from a position downstream from the first horizontal position to the first horizontal position.

11. The feeder apparatus of claim 10 wherein the central drive shaft is splined for cooperating with each of the one sprockets and each guide is a slide rail having a track disposed therein and each glide frame includes a glide element cooperating with the track in the slide rail and having a bracket connected to the entrained belt at one end thereof and the suction member at the other end thereof.

12. The feeder apparatus of claim 11 wherein there are at least two first suction members and at least two second suction members and one cage assembly for each suction member.

13. The feeder apparatus of claim 12 wherein each cage assembly is supported on a transverse support rod and adapted to be moveable relative to the support rod and selectively locked into a position on the support rod to selectively control the transverse distance between each cage.

14. A sheet feeding apparatus comprising:

A) a platform for supporting a stack of sheets with an exposed top sheet;

B) first and second suction members each having vacuum means for holding the top sheet and being movable along a generally horizontal path between a first, pick-up position and a second, drop-off position while holding the top sheet and between the second, drop-off position and first, pick-up position without holding a sheet;

C) means for driving each of the suction members along a generally vertical path between a third position and a fourth position below the third position without holding a sheet and between the fourth position and a position above the fourth position while holding the top sheet;

D) switch means for turning each of the vacuum means ON and OFF, the suction members being driven or holding the top sheet when the vacuum means is ON; and, E) guide means for supporting and moving each of the suction members between the first, pick-up position and the second, drop-off position, the guide means including a cage assembly having two sprockets therein with each sprocket being proximate each end thereof and a belt entrained around the sprockets, the suction member being attached to the belt.

15. The feeder apparatus of claim 14 wherein the first and second suction members are each suction cups secured to a hydraulic or pneumatic cylinder.

16. The feeder apparatus of claim 15 wherein each cylinder has a chamber at one end connected to a vacuum line and a rod at the other end supporting the suction cup, the sucker cup being moveable in a generally vertical direction between the third and fourth positions.

17. The feeder apparatus of claim 14 wherein each cage assembly has a guide disposed between the two sprockets and the suction member has a glide frame cooperating with the guide and supporting the suction member.

18. The feeder apparatus of claim 17 wherein one sprocket in each cage assembly is driven by a reciprocating motor and the other sprocket is driven by the entrained belt.

19. The feeder apparatus of claim 18 wherein the reciprocating motor rotates a central drive shaft in a first direction and a second direction such that when the drive shaft is rotating in the first direction the first suction member travels from the first, pick-up position to the second, drop-off position and the second suction member simultaneously travels from the second, drop-off position to the first, pick-up position and when the drive shaft is rotating in the second direction the first suction member travels from the second, drop-off position to the first, pick-up position and the second suction member simultaneously travels from the first, pick-up position to the second, drop-off position.

20. The feeder apparatus of claim 19 wherein the central drive shaft is splined for cooperating with each one sprocket.

21. The feeder apparatus of claim 20 wherein the guide is a slide rail having a track disposed therein and the glide frame includes a glide element cooperating with the track in the slide rail and has a bracket connected to the entrained belt at one end thereof and the suction member at the other end thereof.

22. The feeder apparatus of claim 21 wherein there are at least two horizontally parallel first suction members, at least two horizontally parallel second suction members, and one cage assembly for each suction member.

23. The feeder apparatus of claim 22 wherein each cage assembly is supported on a transverse support rod and adapted to be moveable relative to the support rod and selectively locked into a position on the support rod to selectively control the transverse distance between each cage assembly.

24. A method for feeding a sheet comprising the steps of:

A) supporting a plurality of sheets stacked on top of each other with an exposed top sheet;

B) positioning a first gripper member connected to a first vacuum means in a first position;

C) tuning the first vacuum means ON to drive the first gripper member vertically downwardly to pick up the top sheet and vertically upwardly with the top sheet;

D) moving the first gripper member along a generally horizontal path from the first position to a second position while holding the top sheet by a cage assembly having opposed sprockets therein and an entrained belt supporting the first gripper member;

E) turning the first vacuum means OFF to release the top sheet from the first gripper member; and, F) moving the first gripper member by the cage assembly from the second position to the first position without holding a sheet.

25. The method of claim 24 further including the steps of:

G) positioning a second gripper member connected to a second vacuum means in a first position;

H) turning the second vacuum means ON to drive the second gripper member vertically downwardly to pick up the top sheet and vertically upwardly with the top sheet;

I) moving the second gripper member along a generally horizontal path from the first position to a second position while holding the top sheet;

J) turning the second vacuum means OFF to release the top sheet from the second gripper member; and, K) moving the second gripper member from the second position to the first position without holding a sheet;

L) coordinating the vacuums means and the gripper members so that i) while the first gripper member is moving from the first position to the second position with a top sheet, the second gripper member is moving from the second position to the first position without a sheet and ii) while the first gripper member is moving from the second position to the first position without a sheet the second gripper member is moving from the first position to the second position with a top sheet.

26. A method for feeding a sheet comprising the steps of:

A) supporting a plurality of sheets stacked on top of each other with an exposed top sheet;

B) positioning a first gripper member connected to a first vacuum means in a first position and a second gripper member connected to a second vacuum means in a second position;

C) turning the first vacuum means ON to drive the first gripper member vertically downwardly to pick up the top sheet and vertically upwardly with the top sheet;

D) moving the first gripper member along a generally horizontal path from the first position to a second position while holding the top sheet while moving the second gripper member from the second position to the first position without holding a sheet, both gripper members being moved by a cage assembly having opposed sprockets therein and an entrained belt supporting the gripper member;

E) turning the first vacuum means OFF to release the top sheet from the first gripper member while turning the second vacuum means ON to drive the second gripper member vertically downwardly to pick up the top sheet and vertically upwardly with the top sheet;

F) moving the first gripper member by the cage assembly associated therewith from the second position to the first position without holding a sheet while moving the second gripper member by the cage assembly associated therewith along a generally horizontal path from the first position to a second position while holding the top sheet;

G) turning the second vacuum means OFF to release the top sheet from the second gripper member.

27. The method of claim 26 wherein the steps of: (C) turning the first vacuum means ON to drive the first gripper member vertically downwardly to pick up the top sheet and vertically upwardly with the top sheet and (G) turning the second vacuum means OFF to release the top sheet from the second gripper member, can be performed simultaneously.

* * * * *

UNITED STATES PATENT AND TRADEMARK OFFICE

CERTIFICATE OF CORRECTION

PATENT NO. : 5,803,447
DATED : September 8, 1998
INVENTOR(S) : Karl Singer, Robert Allen Crimmins and Lawrence B. LeStarge It is certified that errors appear in the above-identified patent and that said Letters Patent is hereby corrected as shown below:

Col. 6, line 2, delete "wheel 135" and insert therefor --wheel 136--

Col. 8, line 18, delete "hiving" and insert therefor --having--

Col. 8, line 51, after "claim 5" delete "Wherein" and insert therefor --wherein--

Col. 8, line 65, delete "Molding" and insert therefor --holding--

Col. 10, line 65, delete "tuning" and insert therefor --turning--

Signed and Sealed this

Twenty-third Day of March, 1999

*Attest:*

Q. TODD DICKINSON

*Attesting Officer*

*Acting Commissioner of Patents and Trademarks*